US012716262B2

(12) United States Patent
Long

(10) Patent No.: US 12,716,262 B2
(45) Date of Patent: Aug. 25, 2026

(54) FENCE PANEL AND FENCE

(71) Applicant: Guangzhou Mibo Zhilian Technology Co. LTD., Guangzhou (CN)

(72) Inventor: Ziyi Long, Beijing (CN)

(73) Assignee: Guangzhou Mibo Zhilian Technology Co. LTD., Guangzhou (CN)

( * ) Notice: Subject to any disclaimer, the term of this patent is extended or adjusted under 35 U.S.C. 154(b) by 0 days.

(21) Appl. No.: 19/317,211

(22) Filed: Sep. 3, 2025

(65) Prior Publication Data

US 2026/0210152 A1 Jul. 23, 2026

(51) Int. Cl.
*E04H 17/16* (2006.01)

(52) U.S. Cl.
CPC ..... *E04H 17/1602* (2021.01); *E04H 17/168* (2013.01)

(58) Field of Classification Search
CPC ..... E04H 17/1413; E04H 17/1447; E04H 17/1482; E04H 17/1488; E04H 17/1602; E04H 17/163; E04H 17/165; E04H 17/168; E04H 17/18; E04H 17/185
USPC ..... 256/25, 65.03
See application file for complete search history.

(56) References Cited

U.S. PATENT DOCUMENTS 2,468,296 A * 4/1949 Jacobowitz ..... B01D 29/39 210/486
3,997,144 A * 12/1976 Parisien ..... E06B 11/02 160/371
4,194,338 A * 3/1980 Trafton ..... E01F 9/685 256/65.03
6,944,989 B1 * 9/2005 Bradley ..... A01G 13/22 47/20.1
6,966,735 B1 * 11/2005 Yamazaki ..... F16B 43/009 411/536
9,580,930 B2 * 2/2017 Sadinsky ..... E04H 17/163
10,132,101 B1 * 11/2018 Hongthong ..... E04H 17/18

* cited by examiner

*Primary Examiner* — Amber R Anderson
*Assistant Examiner* — Zachary A Hall
(74) *Attorney, Agent, or Firm* — Jose Cherson Weissbrot

(57) ABSTRACT

The present disclosure relates to a fence panel and a fence. The fence panel includes a frame and a connecting member, where the frame includes a longitudinal tube and a top transverse tube, and the longitudinal tube is connected to the top transverse tube by means of the connecting member; the longitudinal tube is provided with a first insertion port, and the top transverse tube is provided with a second insertion port; the connecting member includes a first insertion end and a second insertion end that are oppositely arranged, the first insertion end is inserted into the first insertion port, and the first insertion end is securely connected to the longitudinal tube; and the second insertion end is inserted into the second insertion port, and the second insertion end is securely connected to the top transverse tube.

7 Claims, 7 Drawing Sheets

FENCE PANEL AND FENCE

TECHNICAL FIELD

The present disclosure relates to the field of fences, and in particular to a fence panel and a fence.

BACKGROUND

Acrylic metal fences are widely applied in household, pet and commercial scenarios, and are used for various purposes, such as area isolation, protection and decoration. These metal fences are typically composed of metal frames and transparent acrylic face plates, and have good aesthetic appearance and strength. Since an acrylic material has the characteristics of having high transparency and being durable and non-fragile, the acrylic metal fences have a wide range of applications in terms of safety and visual effect in combination with the robustness of the metal frames.

SUMMARY

The present disclosure provides a fence panel, which includes:

a frame including a longitudinal tube and a top transverse tube; and a connecting member configured to connect the longitudinal tube and the top transverse tube, the longitudinal tube being provided with a first insertion port, and the top transverse tube being provided with a second insertion port; where the connecting member includes a first insertion end and a second insertion end that are oppositely arranged, the first insertion end is inserted into the first insertion port, and the first insertion end is securely connected to the longitudinal tube; and the second insertion end is inserted into the second insertion port, and the second insertion end is securely connected to the top transverse tube.

The present disclosure further provides a fence, which includes a plurality of fence panels, adjacent fence panels being connected in an articulated manner;

where the fence panel includes:

a frame including a longitudinal tube and a top transverse tube; and a connecting member, the longitudinal tube being connected to the top transverse tube by means of the connecting member; where the longitudinal tube is provided with a first insertion port, and the top transverse tube is provided with a second insertion port; the connecting member includes a first insertion end and a second insertion end that are oppositely arranged, the first insertion end is inserted into the first insertion port, and the first insertion end is securely connected to the longitudinal tube; and the second insertion end is inserted into the second insertion port, and the second insertion end is securely connected to the top transverse tube.

BRIEF DESCRIPTION OF THE DRAWINGS

In accompanying drawings, the same reference signs denote the same or similar components or elements throughout multiple drawings unless otherwise specified. These drawings are not necessarily drawn to scale. It should be understood that these drawings depict only some implementations according to the present disclosure and should not be construed as limiting the scope of the present disclosure.

LIST OF REFERENCE SIGNS

100. Fence panel; 1. First fastener; 11. Inner wall; 2. Second fastener; 3. Frame; 31. Longitudinal tube; 311. First insertion port; 312. First alignment hole; 32. Bottom transverse tube; 322. Catch slot; 33. Top transverse tube; 331. Second insertion port; 332. Second alignment hole; 4. Supporting foot; 41. Supporting end; 42. Connecting end; 43. Snap-in post; 44. Anti-slip pad; 45. Third through hole; 46. Arc-shaped groove; 5. Face plate; 6. First rivet; 7. Second rivet; 8. Connecting member; 81. First insertion end; 83. First through hole; 82. Second insertion end; 84. Second through hole; 9. Strip-shaped groove.

DETAILED DESCRIPTION OF EMBODIMENTS

Only some exemplary embodiments are briefly described below. As can be appreciated by those skilled in the art, modifications may be made to the described embodiments in various ways without departing from the spirit or scope of the present disclosure. Therefore, the accompanying drawings and the description are considered as exemplary in nature rather than limiting.

Figure 1:
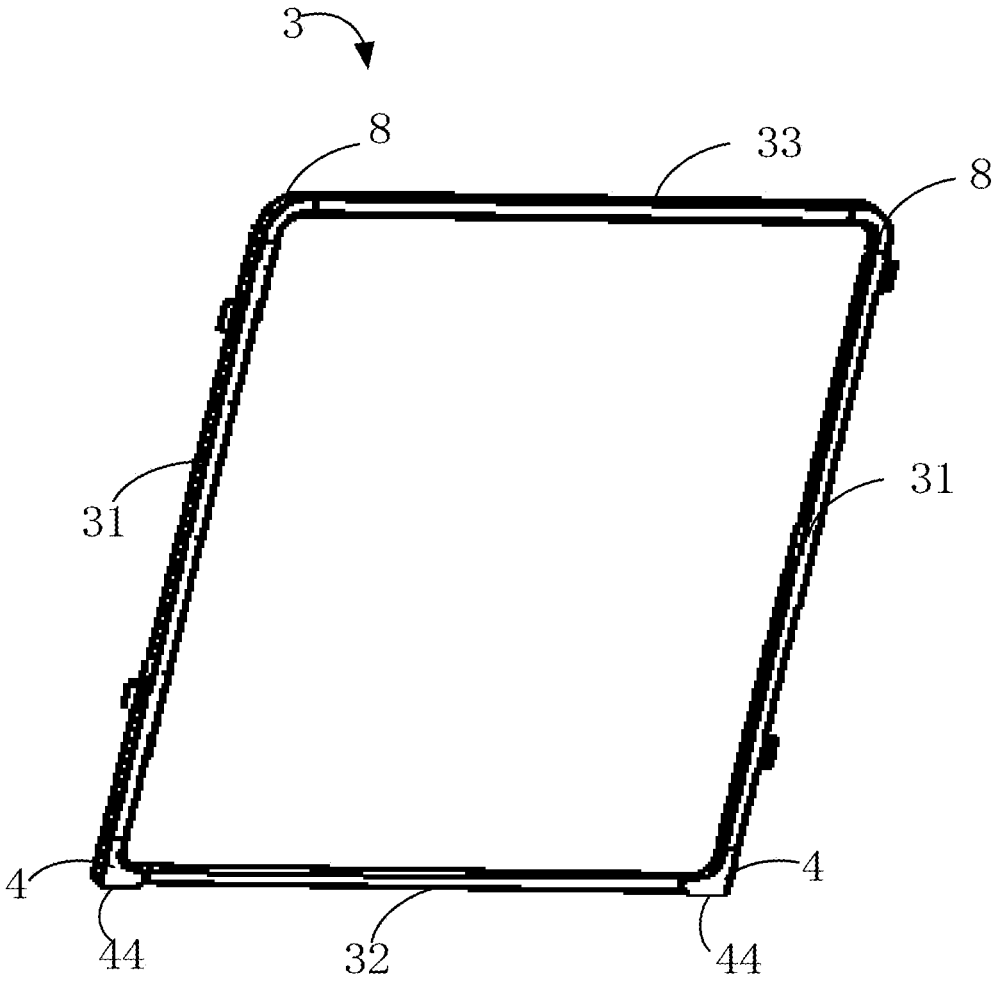
FIG. 1 is a schematic structural perspective view of a fence panel according to an embodiment of the present disclosure.
Figure 2:
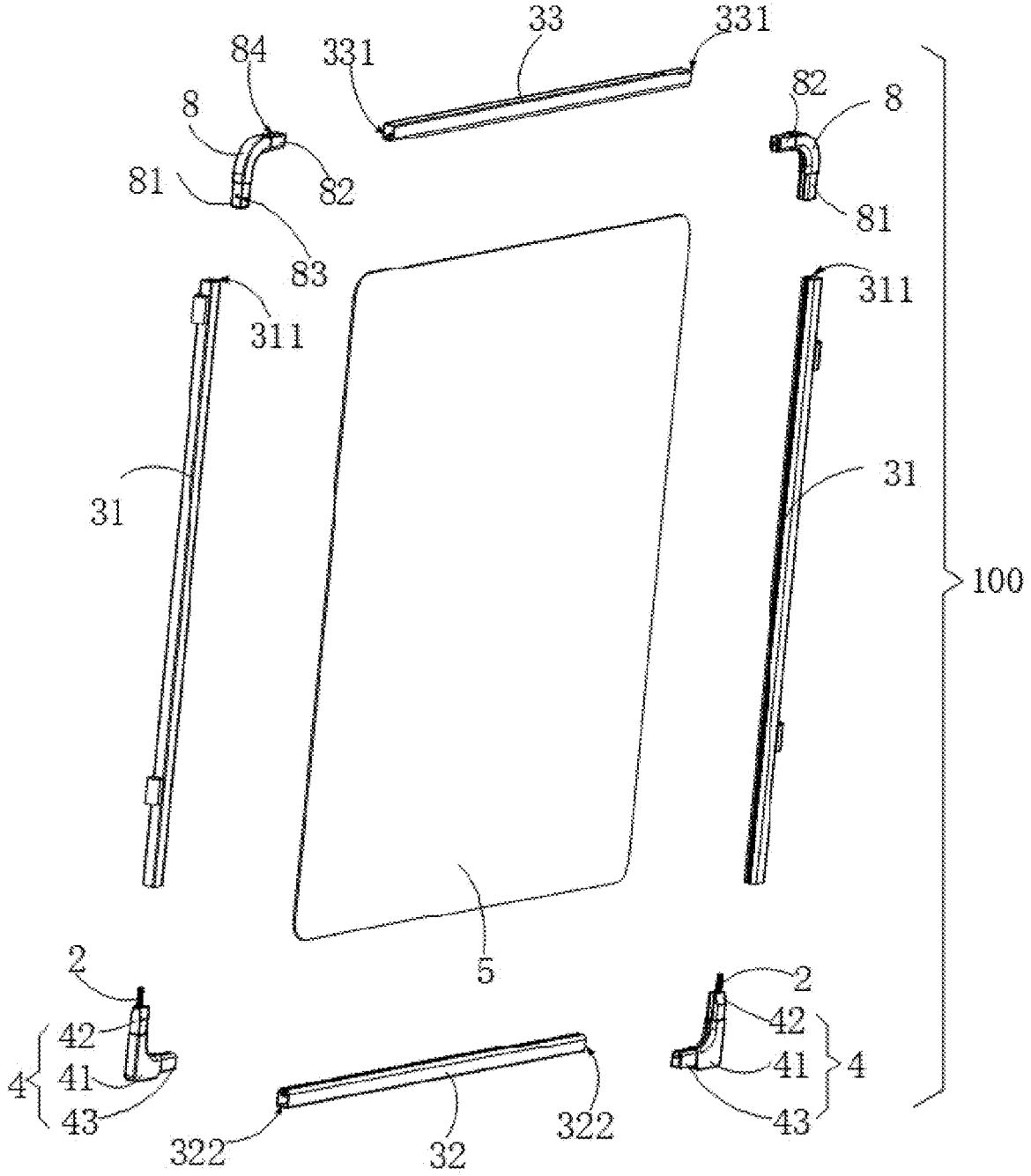
FIG. 2 is a schematic structural exploded view of a fence panel according to an embodiment of the present disclosure.
Figure 3:
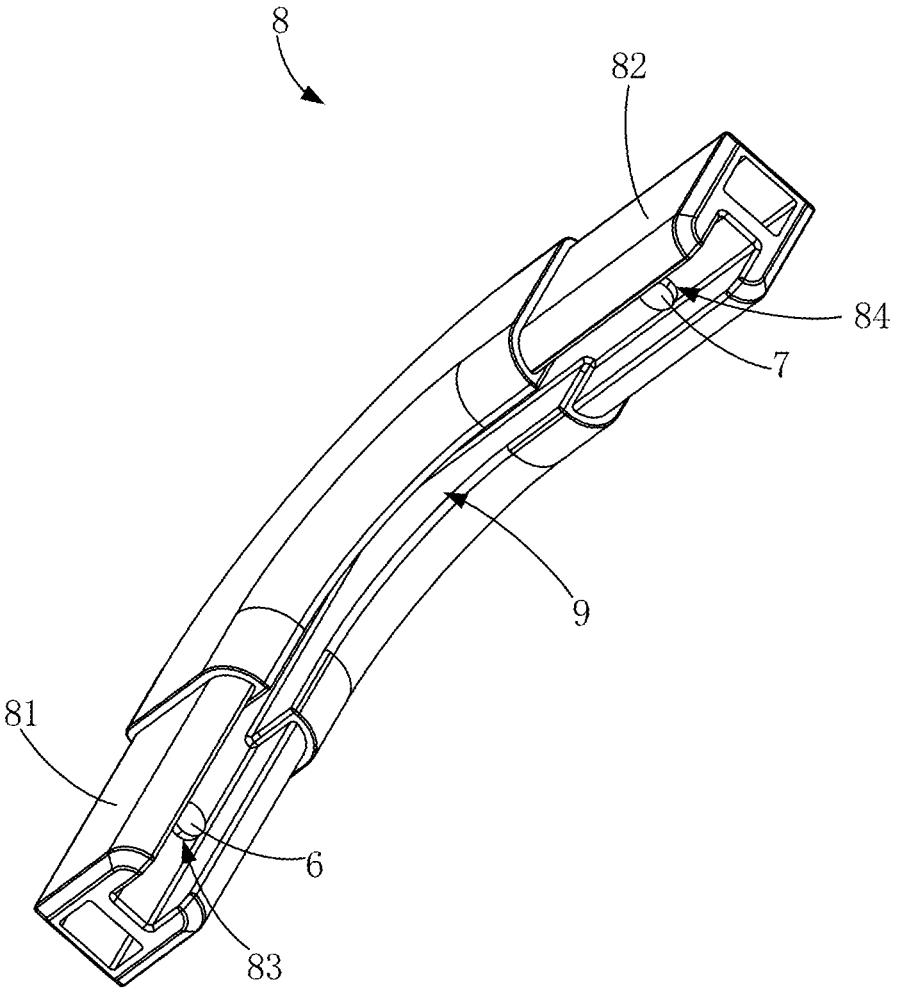
FIG. 3 is a schematic structural diagram of a connecting member according to an embodiment of the present disclosure.
Figure 4:
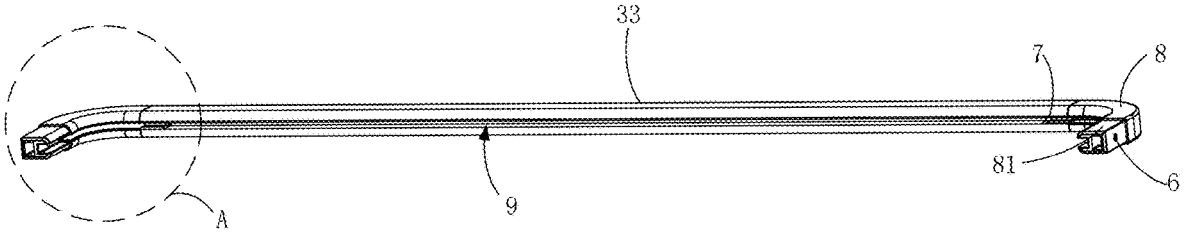
FIG. 4 is a schematic structural diagram of a top transverse tube mounted with connecting members according to an embodiment of the present disclosure.
Figure 5:
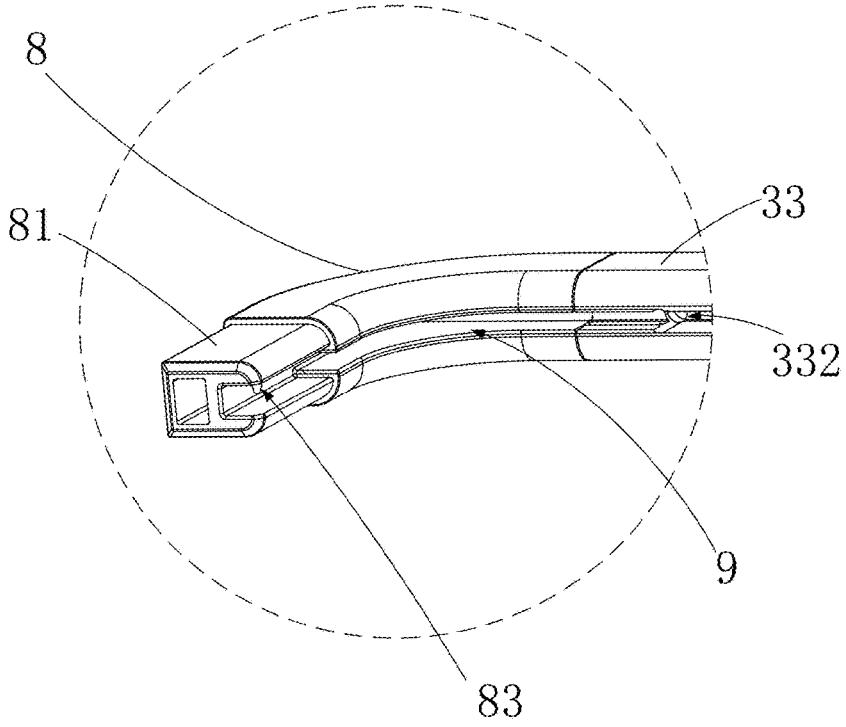
FIG. 5 is a schematic enlarged view of part A in FIG. 4.
Figure 6:
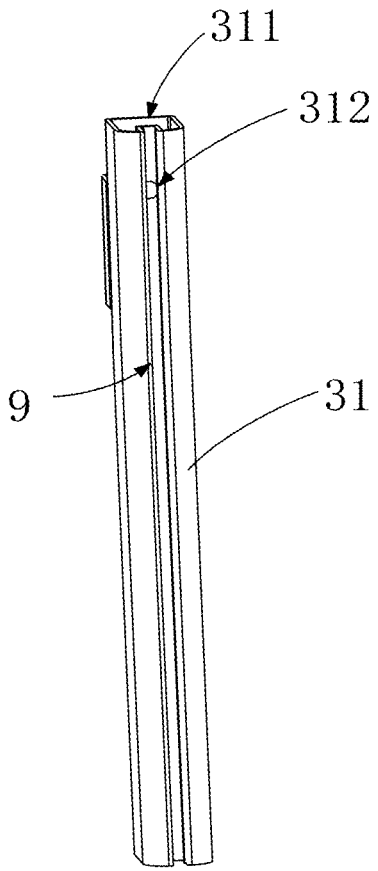
FIG. 6 is a schematic structural diagram of a longitudinal tube according to an embodiment of the present disclosure.

With reference to FIGS. 1 to 3, the present disclosure provides a fence panel 100, which includes a frame 3 and a connecting member 8, where the frame 3 includes a longitudinal tube 31 and a top transverse tube 33, the longitudinal tube 31 is provided with a first insertion port 311, and the top transverse tube 33 is provided with a second insertion port 331; the connecting member 8 is configured to connect the longitudinal tube 31 and the top transverse tube 33, the connecting member 8 includes a first insertion end 81 and a second insertion end 82 that are oppositely arranged, the first insertion end 81 is inserted into the first insertion port 311, and the first insertion end 81 is securely connected to the longitudinal tube 31; and the second insertion end 82 is inserted into the second insertion port 331, and the second insertion end 82 is securely connected to the top transverse tube 33. The first insertion end 81 of the connecting member 8 is inserted into the first insertion port 311 of the longitudinal tube 31, and the second insertion end 82 of the connecting member 8 is inserted into the second insertion port 331 of the top transverse tube 33. Such an insertion method is efficient and simple, does not require a complex tool, and is easy for a user to operate.

With reference to FIGS. 3 to 6, specifically, the fence panel 100 further includes a first rivet 6 and a second rivet 7, a first alignment hole 312 is provided at an end of the longitudinal tube 31 facing the top transverse tube 33, the first insertion end 81 is provided with a first through hole 83 corresponding to the first alignment hole 312, and the first rivet 6 passes through the first through hole 83 and the first alignment hole 312 to rivet the connecting member 8 and the longitudinal tube 31; a second alignment hole 332 is provided at an end of the top transverse tube 33 facing the longitudinal tube 31, the second insertion end 82 is provided with a second through hole 84 corresponding to the second alignment hole 332, and the second rivet 7 passes through the second through hole 84 and the second alignment hole 332 to rivet the connecting member 8 and the top transverse tube 33. The first insertion end 81 of the connecting member 8 is secured to the longitudinal tube 31 in a riveting manner, and the second insertion end 82 is also secured to the top transverse tube 33 in a riveting manner, thereby achieving a relatively good securing effect between the top transverse tube 33 and the longitudinal tube 31 and obtaining a relatively stable structure of the frame 3. It should be understood that, in other embodiments, other connection methods, for example, screwed connection or snap-fit connection, may also achieve a stable connection of the connecting member 8, the longitudinal tube 31 and the like to some extent, which will not be described in detail herein.

Figure 7:
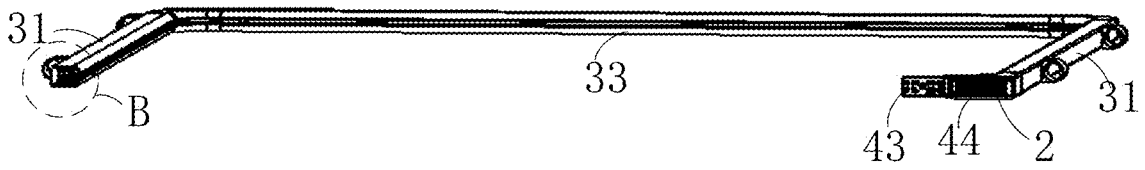
FIG. 7 is a schematic structural diagram of a frame without a bottom transverse tube according to an embodiment of the present disclosure.
Figure 8:
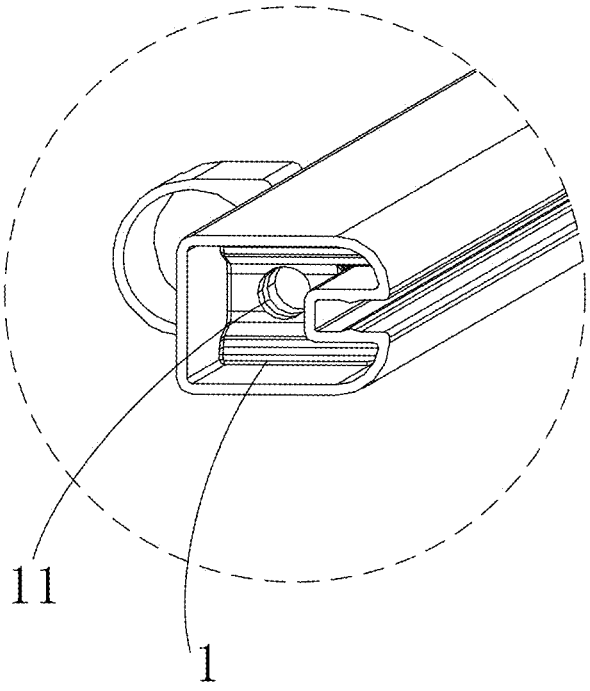
FIG. 8 is a schematic enlarged view of part B in FIG. 7.
Figure 9:
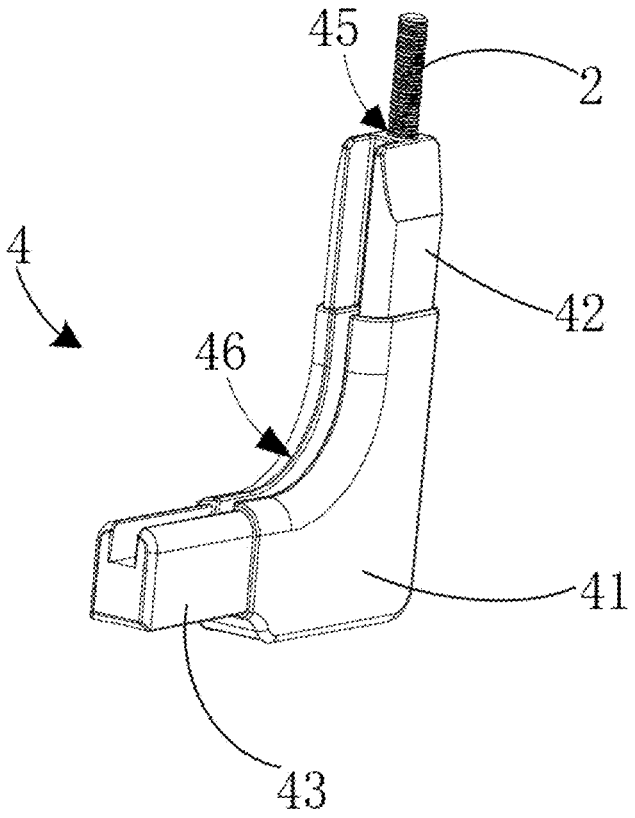
FIG. 9 is a schematic structural diagram of a supporting foot according to an embodiment of the present disclosure.

With reference to FIGS. 2, 7 and 8, in one of the embodiments, the fence panel 100 further includes a first fastener 1, a second fastener 2 and a supporting foot 4, the frame 3 includes a longitudinal tube 31, and the first fastener 1 is disposed at an end of the longitudinal tube 31. The supporting foot 4 includes a supporting end 41 and a connecting end 42 that are oppositely arranged, where the supporting end 41 is configured for contacting with a floor, and the connecting end 42 is inserted into the end of the longitudinal tube 31 provided with the first fastener 1; the supporting foot 4 is internally provided with a third through hole 45 running through the supporting end 41 and the connecting end 42, and the second fastener 2 is securely connected to the first fastener 1 by passing through the third through hole 45 in the supporting end 41 and the connecting end 42 in sequence, thereby mounting the supporting foot 4 to the longitudinal tube 31. As the first fastener 1 is disposed in the longitudinal tube 31 and then the second fastener 2 is securely connected to the first fastener 1 by passing through the supporting foot 4, a better effect of securing the supporting foot 4 and the longitudinal tube 31 is achieved, and the frame 3 is firmly secured to the supporting feet 4; moreover, mounting steps are simple and easy for a user to operate. A nut can be embedded into the first fastener 1 to be in secure fit with the second fastener 2.

With reference to FIGS. 7 and 8, specifically, the first fastener 1 is embedded into the longitudinal tube 31, an inner wall 11 of the first fastener 1 is provided with a thread mating with the second fastener 2, the second fastener 2 is a screw, and the screw engages with the thread. The first fastener 1 is embedded into the longitudinal tube 31, so that the first fastener 1 can be protected from being affected by an external environment, and the appearance tidiness can also be improved. This screw and thread design is easy for the user to mount the supporting foot 4 to the frame 3, the operation is simple and easy, and a good securing effect can also be achieved.

In another embodiment, the inner wall 11 of the first fastener 1 is provided with a snap-fit part, the second fastener 2 is a snap-fit part corresponding to the snap-fit part on the inner wall 11 of the first fastener 1, and the first fastener 1 and the second fastener 2 are secured together in a snap-fit manner. This snap-fit design is easy for the user to mount the supporting foot 4 to the frame 3, the operation is simple and easy, and a good securing effect can also be achieved.

In one of the embodiments, the first fastener 1 may be secured in the longitudinal tube 31 by means of the snap-fit part, or the first fastener 1 may be nailed in the longitudinal tube 31 by means of a nail.

With reference to FIGS. 1 and 2, in one of the embodiments, the frame 3 further includes a bottom transverse tube 32, and catch slots 322 are formed in two ends of the bottom transverse tube 32 respectively. The supporting foot 4 further includes a snap-in post 43, and the snap-in post 43 is inserted in the catch slot 322 and configured to secure one of the supporting feet 4 to each of the two ends of the bottom transverse tube 32 respectively. The snap-in post 43 is embedded into the catch slot 322, and the snap-in post and the catch slot are connected in a snap-fit manner, thereby achieving simple mounting and stable embedding, and effectively solving the problem of misalignment or looseness. The snap-in post 43 and the catch slot 322 are further secured by means of a fixing pin.

With reference to FIGS. 1 to 3 and FIG. 9, in one of the embodiments, the top transverse tube 33 and the bottom transverse tube 32 are oppositely arranged vertically, one end of the top transverse tube is connected to the corresponding end of the bottom transverse tube 32 by means of one connecting member 8 and one longitudinal tube 31 in sequence, and the other end of the top transverse tube is connected to the corresponding other end of the bottom transverse tube by means of the other connecting member 8 and the other longitudinal tube 31 in sequence. In this way, one top transverse tube, one bottom transverse tube and two longitudinal tubes 31 form the rectangular frame 3 in an enclosure manner. Specifically, the fence panel further includes a face plate 5 embedded into the frame 3; and the bottom transverse tube, the top transverse tube, the longitudinal tube 31 and the connecting member 8 are each provided with a strip-shaped groove 9 in respective length directions, the strip-shaped groove 9 is formed as an elongated receiving space, and each edge of the face plate 5 is inserted into the strip-shaped groove 9 such that the face plate 5 is embedded into the frame 3. Such a design allows the face plate 5 to be stably snapped into the frame 3 and is less prone to detachment. An effect of securing the face plate 5 on the frame 3 can be improved by adding rubber strips or snap-fit parts as required. The supporting foot 4 is further provided with an arc-shaped groove 46 corresponding to the face plate 5, which is configured for the insertion of a corner edge of the face plate 5 in order to more stably secure the face plate 5 in the frame 3.

With reference to FIGS. 1 to 3, in one of the embodiments, the connecting member 8 may be made of a plastic or metal material. The frame 3 is made of the metal material, for example, an aluminum alloy. The second fastener 2 is made of the metal material, for example, an iron nail. The face plate 5 is an acrylic plate.

With reference to FIGS. 7 and 8, in one of the embodiments, an anti-slip pad 44 is disposed on a side of the supporting end 41 facing the floor. The second fastener 2 is securely connected to the first fastener 1 by passing through the anti-slip pad 44, the supporting end 41 and the connecting end 42 in sequence, thereby mounting the anti-slip pad 44 to the supporting end 41. As the anti-slip pad 44 is disposed at the bottom of the supporting foot 4, an anti-slip function is provided for an entire structure, and meanwhile the anti-slip pad 44 can effectively prevent the friction between the fence and the floor and reduce wear and noise, which are beneficial to protecting the floor and the supporting foot 4 and improving the user experience.

It should be understood that the anti-slip pad 44 may also be fixed to the bottom of the supporting foot 4 by other means, for example, adhesion or welding. A silicone pad may be used as the anti-slip pad 44.

The mounting steps of the supporting foot 4 and the longitudinal tube 31 are as follows: first, the first fastener 1 is inserted into one end of the longitudinal tube 31, to allow the first fastener to be completely embedded into the longitudinal tube 31; second, the snap-in post 43 of the supporting foot 4 is aligned to the catch slot 322 of the bottom transverse tube, and the snap-in post 43 are inserted along the catch slot 322 until the snap-in post is completely embedded into the catch slot 322; and third, the second fastener 2 passes through the anti-slip pad 44, the supporting end 41 and the connecting end 42 in sequence, and is aligned to the first fastener 1; when the second fastener 2 is the screw, the first fastener 1 and the second fastener 2 are screwed with a tool, such that the first fastener 1 and the supporting foot 4 press against each other to form a tight fit, and the anti-slip pad 44 is concurrently locked at the bottom of the supporting foot 4. The above mounting steps are simple and easy for the user to operate.

With reference to FIG. 1, the present disclosure further provides a fence, which includes a plurality of fence panels 100, adjacent fence panels 100 are connected in an articulated manner, and a plurality of fence panels 100 enclose an area for animal activity. The fence is assembled only by means of articulation and the like, without a complex welding process, and is simple and easy to mount.

The above technical solution has at least the following advantages or beneficial effects:

In the fence panel provided in the present disclosure, the first insertion end 81 of the connecting member 8 is inserted into the first insertion port 311 of the longitudinal tube 31, and the second insertion end 82 of the connecting member 8 is inserted into the second insertion port 331 of the top transverse tube 33. Such an insertion method is efficient and simple, does not require a complex tool, and is easy for a user to operate. In addition, the first insertion end 81 of the connecting member 8 is secured to the longitudinal tube 31 in a riveting manner, and the second insertion end 82 is also secured to the top transverse tube 33 in a riveting manner, thereby achieving a relatively good securing effect between the top transverse tube 33 and the longitudinal tube 31 and obtaining a relatively stable structure of the frame 3.

In the fence panel provided by the present disclosure, as the first fastener 1 is disposed in the longitudinal tube 31 and then the second fastener 2 is securely connected to the first fastener 1 by passing through the supporting foot 4, a better effect of securing the supporting foot 4 and the longitudinal tube 31 is achieved, and the frame 3 is firmly secured to the supporting feet 4; moreover, the mounting steps are simple and easy for the user to operate.

The first fastener 1 is embedded into the longitudinal tube 31, so that the first fastener 1 can be protected from being affected by an external environment, and the appearance tidiness can also be improved.

As the anti-slip pad 44 is disposed at the bottom of the supporting foot 4, an anti-slip function is provided for an entire structure, and meanwhile the anti-slip pad 44 can effectively prevent the friction between the fence and the floor and reduce wear and noise, which are beneficial to protecting the floor and the supporting foot 4 and improving the user experience.

In the description of this specification, expressions with reference to the terms such as "an embodiment", "some embodiments", "example", "specific example", or "some examples" mean that specific features, structures, materials, or characteristics described with reference to the embodiment or example are included in at least one embodiment or example of the present disclosure. Moreover, the specific features, structures, materials or characteristics described can be combined in any one or more embodiments or examples in any suitable manner. In addition, without any contradiction, those skilled in the art may incorporate and combine different embodiments or examples and features of the different embodiments or examples described in this specification.

In addition, the terms "first" and "second" are merely used for the purpose of illustration, and cannot be construed as indicating or implying relative importance or implicitly indicating the number of technical features indicated. Thus, the features defined with "first" and "second" may explicitly or implicitly include at least one of the features. In the description of the present disclosure, the meaning of "a plurality of" is two or more, unless explicitly and specifically defined otherwise.

The above description is merely specific implementations of the present disclosure, but is not intended to limit the scope of protection of the present disclosure. Any variation or replacement readily figured out by a person skilled in the art within the technical scope disclosed in the present disclosure shall fall within the scope of protection of the present disclosure. Therefore, the scope of protection of the present disclosure shall be subject to the scope of protection of the claims.

What is claimed is:

1. A fence panel, comprising:

a frame comprising a longitudinal tube and, a top transverse tube; and a bottom transverse tube;

a connecting member, the longitudinal tube being connected to the top transverse tube by means of the connecting member; wherein the longitudinal tube is provided with a first insertion port, and the top transverse tube is provided with a second insertion port; the connecting member comprises a first insertion end and a second insertion end that are oppositely arranged, the first insertion end is inserted into the first insertion port, and the first insertion end is securely connected to the longitudinal tube; and the second insertion end is inserted into the second insertion port, and the second insertion end is securely connected to the top transverse tube; and the top transverse tube and the bottom transverse tube are oppositely arranged vertically, one end of the top transverse tube is connected to the corresponding end of the bottom transverse tube by means of one said connecting member and one said longitudinal tube in sequence, and the other end of the top transverse tube is connected to the corresponding other end of the bottom transverse tube by means of another said connecting member and another said longitudinal tube in sequence;

a face plate embedded into the frame;

the bottom transverse tube, the top transverse tube, the longitudinal tube and the connecting member are each provided with a strip-shaped groove in respective length directions, the strip-shaped groove is formed as an elongated receiving space, and an edge of the face plate is inserted into each of the strip-shaped grooves, for embedding the face plate into the frame;

a first rivet, a first alignment hole being provided at an end of the longitudinal tube facing the top transverse tube, the first alignment hole being located in the strip-shaped groove of the longitudinal tube, the first insertion end being provided with a first through hole corresponding to the first alignment hole, and the first rivet passing through the first through hole and the first alignment hole to rivet the connecting member and the longitudinal tube; and a second rivet, a second alignment hole being provided at an end of the top transverse tube facing the longitudinal tube, the second alignment hole being located in the strip-shaped groove of the top transverse tube, the second insertion end being provided with a second through hole corresponding to the second alignment hole, and the second rivet passing through the second through hole and the second alignment hole to rivet the connecting member and the top transverse tube, wherein, after the face plate is embedded into the frame, the first rivet and the second rivet are in a concealed state.

2. The fence panel according to claim 1, further comprising:

a first fastener disposed at an end of the longitudinal tube away from the top transverse tube;

a second fastener; and a supporting foot comprising a supporting end and a connecting end that are oppositely arranged, the supporting end being configured for contacting with a floor, and the connecting end being inserted into the end of the longitudinal tube provided with the first fastener; wherein the supporting foot is internally provided with a third through hole running through the supporting end and the connecting end, and the second fastener is securely connected to the first fastener by passing through the third through hole in a direction from the supporting end to the connecting end, thereby mounting the supporting foot to the longitudinal tube.

3. The fence panel according to claim 2, wherein the first fastener is embedded into the longitudinal tube, an inner wall of the first fastener is provided with a thread mating with the second fastener, the second fastener is a screw, and the screw engages with the thread.

4. The fence panel according to claim 2, wherein catch slots are formed in two ends of the bottom transverse tube respectively; and two supporting feet are provided, each of the supporting feet further comprises a snap-in post, and the snap-in post is inserted in the catch slot and configured to secure one of the supporting feet to each of the two ends of the bottom transverse tube.

5. The fence panel according to claim 4, wherein the top transverse tube and the bottom transverse tube are oppositely arranged vertically, two longitudinal tubes are provided, one end of the top transverse tube is connected to the corresponding end of the bottom transverse tube by means of one connecting member and one longitudinal tube in sequence, and the other end of the top transverse tube is connected to the corresponding other end of the bottom transverse tube by means of the other connecting member and the other longitudinal tube in sequence.

6. The fence panel according to claim 2, wherein an anti-slip pad is disposed on a side, facing the floor, of the supporting end.

7. A fence, comprising a plurality of fence panels, adjacent fence panels being connected in an articulated manner; wherein the fence panel comprises:

a frame comprising a longitudinal tube and, a top transverse tube, and a bottom transverse tube;

a connecting member, the longitudinal tube being connected to the top transverse tube by means of the connecting member; wherein the longitudinal tube is provided with a first insertion port, and the top transverse tube is provided with a second insertion port; the connecting member comprises a first insertion end and a second insertion end that are oppositely arranged, the first insertion end is inserted into the first insertion port, and the first insertion end is securely connected to the longitudinal tube; and the second insertion end is inserted into the second insertion port, and the second insertion end is securely connected to the top transverse tube;

and the top transverse tube and the bottom transverse tube are oppositely arranged vertically, one end of the top transverse tube is connected to the corresponding end of the bottom transverse tube by means of one said connecting member and one said longitudinal tube in sequence, and the other end of the top transverse tube is connected to the corresponding other end of the bottom transverse tube by means of another said connecting member and another said longitudinal tube in sequence;

a face plate embedded into the frame;

the bottom transverse tube, the top transverse tube, the longitudinal tube and the connecting member are each provided with a strip-shaped groove in respective length directions, the strip-shaped groove is formed as an elongated receiving space, and an edge of the face plate is inserted into each of the strip-shaped grooves, for embedding the face plate into the frame;

a first rivet, a first alignment hole being provided at an end of the longitudinal tube facing the top transverse tube, the first alignment hole being located in the strip-shaped groove of the longitudinal tube, the first insertion end being provided with a first through hole corresponding to the first alignment hole, and the first rivet passing through the first through hole and the first alignment hole to rivet the connecting member and the longitudinal tube; and a second rivet, a second alignment hole being provided at an end of the top transverse tube facing the longitudinal tube, the second alignment hole being located in the strip-shaped groove of the top transverse tube, the second insertion end being provided with a second through hole corresponding to the second alignment hole, and the second rivet passing through the second through hole and the second alignment hole to rivet the connecting member and the top transverse tube, wherein, after the face plate is embedded into the frame, the first rivet and the second rivet are in a concealed state.

* * * * *